United States Patent [19]

Lauckhardt et al.

[11] 4,442,563

[45] Apr. 17, 1984

[54] SHOE LASTING MACHINE

[75] Inventors: Gerhard Lauckhardt, Rodelheim; Rudi Fichtner, Rosbach; Manfred Bröning, Ffm-Sossenheim, all of Fed. Rep. of Germany

[73] Assignee: USM Corporation, Farmington, Conn.

[21] Appl. No.: 351,667

[22] Filed: Feb. 24, 1982

Related U.S. Application Data

[62] Division of Ser. No. 144,331, Apr. 28, 1980, Pat. No. 4,319,373.

[51] Int. Cl.[3] ..... A43D 21/00

[52] U.S. Cl. ..... 12/145

[58] Field of Search ..... 12/8.3, 10.5, 10.1, 12/10.8, 12.5, 145

[56] References Cited

U.S. PATENT DOCUMENTS

| | | | |
|---|---|---|---|
| 3,315,288 | 4/1967 | Forma | 12/145 |
| 3,908,216 | 9/1975 | Gadd et al. | 12/8.3 |
| 3,971,089 | 7/1976 | Gadd et al. | 12/8.3 |
| 4,074,383 | 2/1978 | Kaplan et al. | 12/8.3 |

*Primary Examiner*—Patrick D. Lawson

*Attorney, Agent, or Firm*—Donald N. Halgren

[57] ABSTRACT

In a machine for cement lasting side portions and the heel seat of shoes, the side portions are lasted by lasting rolls and the heel seat by wiper plates. For applying adhesive, each lasting roll has an associated nozzle which applies adhesive progressively in advance of its associated lasting roll. Furthermore, when the lasting rolls reach the point of termination of side lasting, they remain in pressing engagement with the shoe bottom, but their rotation is terminated, and in this condition the nozzles continue to apply adhesive in the heel seat region. This may be achieved by merely discharging adhesive from the stationary nozzles and allowing it to run into the heel seat, or alternatively the nozzles may track bodily into the heel seat. Thereafter, the lasting rolls and nozzles are retracted and heel seat wiping can take place. The invention may also be incorporated in a machine in which the whole of the shoe bottom is lasted.

3 Claims, 7 Drawing Figures

SHOE LASTING MACHINE

This is a request for filing a application under 37 CFR 1.60, divisional of pending prior application Ser. No. 144,331 filed on Apr. 28, 1980 of Gerhard Lauckhardt and Rudi Fichtner for Shoe Lasting Machine now U.S. Pat. No. 4,319,373.

BACKGROUND OF THE INVENTION

1. Field of the Invention

This invention is concerned with a method of and machine for lasting shoes. The term "shoe" where used herein is used generically as indicating outer footwear generally and including an article of outer footwear in the course of its manufacture.

2. Prior Art

One method of lasting shoes is known (see e.g. U.K. patent specification No. 1,519,145) comprising the steps of applying adhesive between lasting marginal portions of the shoe upper and corresponding marginal portions of an insole along the side portions and in the heel seat region of the shoe, and lasting said side portions and the heel seat, wherein the side portions are lasted progressively, using lasting rolls, starting from the ball region of the shoe bottom and terminating at the heel seat region thereof, adhesive being applied progressively, in advance of the lasting rolls, along the side portions of the shoe, and the heel seat is lasted using wiper plates which overlap the area previously lasted by the lasting rolls.

Similarly, a machine for carrying out the above method is also known (see the aforementioned specification) comprising means for supporting a last carrying a shoe comprising an upper and an insole, side lasting instrumentalities comprising two lasting rolls arranged one at each side of the lasting supporting means, means for effecting relative movement, heightwise of the shoe, between the side lasting instrumentalities and the last supporting means, to bring the lasting rolls into and out of an operative condition, in engagement with the bottom of a shoe supported by the last supporting means, means for effecting relative movement, lengthwise of the shoe, between the last supporting means and the side lasting instrumentalities whereby to cause the lasting rolls, in operative condition, progressively to last opposite side portions of the shoe simultaneously starting at the ball region and terminating at the heel breast line region thereof, heel seat lasting instrumentalities, comprising a wiper plate assembly, for lasting the heel seat region of the shoe, and adhesive applying means, in the form of two nozzles, one associated with each lasting roll, and each being arranged to apply adhesive progressively, along a side portion of the shoe, between lasting marginal portions of the shoe upper and corresponding marginal portions of the insole, in advance of its associated lasting roll, as relative movement is effected as aforesaid between the lasting rolls and the last supporting means.

In using the aforementioned machine, in carrying out said method, adhesive is applied in the heel seat region as a separate step in the sequence of operations, after the side lasting operation has been completed and before actuation of the heel seat wiper assembly. Furthermore, the application of adhesive in the heel seat region does not take place until after the lasting rolls have been moved out of their operative condition, in engagement with the shoe bottom. It will be appreciated that this arrangement is not only time-consuming, thus unnecessarily extending the time cycle for the whole lasting sequence, but further two separate adhesive supply systems and adhesive applying means are thus required. Furthermore, any tendency of the lasting margin, at the point of termination of the side lasting, to come away from the insole may not readily be rectified in the subsequent heel seat lasting operaation, with the result that the whole of the lasting margin may not be adequately secured to the insole.

BRIEF SUMMARY OF THE INVENTION

It is the object of the present invention to provide an improved method of and machine for lasting shoes, more especially the side portions and heel seat thereof, wherein the problems of using two separate adhesive applying means are overcome and further any problem concerning maintaining the lasting margin secured to the insole at the point of termination of the side lasting is mitigated.

With this object in mind, the invention provides a method of lasting shoes comprising the steps of applying adhesive between lasting marginal portions of the shoe upper and corresponding marginal portions of an insole along the side portions and in the heel seat region of the shoe, and lasting said side portions and the heel seat, wherein the side portions are lasted progressively, using lasting rolls, starting from the ball region of the shoe bottom and terminating at the heel seat region thereof, adhesive being applied progressively, in advance of the lasting rolls, along the side portions of the shoe, and the heel seat is lasted using wiper plates which overlap the area previously lasted by the lasting rolls, and further wherein, when the lasting of the side portions is completed, the lasting rolls are maintained in contact with the shoe bottom, and thus pressure is applied thereby to the shoe bottom, at the point of termination of the side lasting, while adhesive continues to be applied progressively in the heel seat region, whereafter the applied pressure is removed by retraction of the lasting rolls and the heel seat region is lasted.

Furthermore, the invention also provides a machine for lasting shoes comprising means for supporting a last carrying a shoe comprising an upper and an insole, side lasting instrumentalities, comprising two lasting rolls arranged one at each side of the last supporting means, means for effecting relative movement, heightwise of the shoe, between the side lasting instrumentalities and the last supporting means, to bring the lasting rolls into and out of an operative condition, in engagement with the bottom of a shoe supported by the last supporting means, means for effecting relative movement, lengthwise of the shoe, between the last supporting means and the side lasting instrumentalities whereby to cause the lasting rolls, in operative condition, progressively to last opposite side portions of the shoe simultaneously, starting at the ball region and terminating at the heel breast line region thereof, heel seat lasting instrumentalities, comprising a wiper plate assembly, for lasting the heel seat region of the shoe, and adhesive applying means, in the form of two nozzles, one associated with each lasting roll, and each being arranged to apply adhesive progressively, along a side portion of the shoe, between lasting marginal portions of the shoe upper and corresponding marginal portions of the insole, in advance of its associated lasting roll, as relative movement is effected as aforesaid between the lasting rolls and the last supporting means, wherein, when, in the operation of the machine, the relative movement between the last supporting means and the side lasting instrumentalities is arrested with said instrumentalities in the heel breast line region, the lasting rolls remain in operative condition, pressure thus continuing to be applied thereby to the shoe bottom, while the nozzles are caused to continue progressive application of adhesive in the heel seat region, whereafter the side lasting instrumentalities and the nozzles therewith are moved out of operative condition and the heel seat lasting instrumentalities are actuated, the arrangement being such that the heel seat lasting instrumentalities overlap the area previously lasted by the side lasting instrumentalities.

It will thus be appreciated that in carrying out said method, using said machine, a single adhesive applying means may be used, thus shortening the overall machine cycle time, and furthermore the lasting margin, at the point of termination of the side lasting, is firmly held in contact with the insole by the lasting rolls during the application of adhesive to the heel seat, so that only a small time remains between the removal of the pressure from the lasting rolls and the in-wiping of the heel seat wiper assembly. Furthermore, since the heel seat wiper assembly overlaps the area previously lasted by the lasting rolls, it is likely that, should the secured lasting margin begin to come away at the point of termination of the side lasting, it will be re-secured to the insole by the heel seat wiper assembly.

The lasting rolls described in the aforementioned specification each comprise a wiping element disposed helically about the circumference of the roll, the in-wiping of the lasting marginal portion of the shoe upper thus being effected by rotation of the roll about its axis. It will be appreciated that damage could ensue to the shoe upper if the lasting rolls continued to so rotate at the end of the side lasting operation, while they are maintaining the pressure on the lasting margin. Thus, in carrying out the method in accordance with the invention, when the side lasting is terminated preferably the rotation of the rolls is also terminated.

In carrying out said method, the progressive application of adhesive in the heel seat region may be achieved merely by continuing to discharge adhesive from the nozzles of the adhesive applying means of the machine, while said nozzles remain in a fixed position in relation to the lasting rolls. Especially where the shoe bottom is held significantly inclined to the horizontal, the discharged adhesive can then flow towards the back seam region of the shoe bottom. On the other hand, it may be preferable, in accordance with the invention, that, when relative movement between the last supporting means and side lasting instrumentalities of the machine is arrested as aforesaid, relative movement between the nozzles and last supporting means continues, thus to cause adhesive to be applied in the heel seat region by said nozzles. In such a case, the nozzles have of course to be capable of movement relative to the lasting rolls (as compared e.g. with the nozzles in the aforementioned specification which are in a fixed relationship with the lasting rolls).

The invention is especially suited in a method for lasting the whole of the length of the shoe bottom, i.e. from the toe end to the heel end thereof. A machine for carrying out a method of lasting the whole of the length of a shoe, using adhesive, is described e.g. in U.K. patent specification No. 1087698, in the operation of which machine firstly adhesive is applied in the toe region by means of an adhesive-applying so-called insole plate, while more or less simultaneously adhesive is applied progressively along opposite sides of the shoe, starting from the heel seat and terminating adjacent the insole plate. The lasting operation then takes place firstly at the heel seat, and thereafter in the shank region, and finally in the toe and ball regions, each successive operation being effected by wiper assemblies comprising wiper plates. A disadvantage of this arrangement resides in that, although adhesive is first applied in the toe region, the lasting of the toe takes place only after the heel seat and shank regions of the shoe bottom have been lasted. This necessarily leads to a certain cooling of the adhesive, which is customarily a hot melt adhesive, so that its adhesiveness is reduced. A further disadvantage resides in that the shank wipers operate after the heel seat wipers, but while the heel seat wipers remain in operative condition, so that there can be no overlapping of the areas which the separate wiper assemblies last, with a consequence that creasing can take place in the breast line region.

In accordance with the invention, therefore, preferably the shoe upper is first pulled over on a last to which the insole is attached and is held tensioned thereon while adhesive is applied to the toe end region of the shoe bottom, and thereafter, as soon as the ball region of the shoe has been lasted by the lasting rolls, the toe end region is lasted using wiper plates which overlap the area previously lasted by the lasting rolls. Furthermore, in a machine in accordance with the invention, preferably there are provided toe lasting instrumentalities and further adhesive applying means for applying adhesive in the toe region of the shoe, the further adhesive applying means being actuated, in the operation of the machine, before the first-mentioned adhesive applying means and the toe lasting instrumentalities being actuated as soon as the side lasting instrumentalities have lasted the ball region. In this way, the toe end of the shoe is lasted before the adhesive has had any opportunity to cool, and similarly since the adhesive is applied progressively along the side portions of the shoe, in advance of the lasting rolls, no opportunity is afforded for the cooling of the adhesive along the side regions, and similarly heel seat lasting takes place without any opportunity of the adhesive applied in that region to cool.

Conveniently, said further adhesive applying means comprises two nozzles, arranged one at either side of the last supporting means, and each nozzle being arranged to apply adhesive between lasting marginal portions of the shoe upper and corresponding marginal portions of the insole, starting at the ball region and terminating at the toe end. The machine in accordance with the invention may be generally similar, except as hereinafter described, to the machine described in U.K. patent specification No. 1341461, the machine beng provided, however, with heel seat lasting instrumentalities, replacing the heel support provided in said machine. It will thus be appreciated, however, that if heel seat lasting is to take place during the same machine cycle as the toe lasting, it will be necessary to provide facilities for adjusting the positional relationship between the toe lasting instrumentalities and the heel seat lasting instrumentalities, thus to accommodate different styles of shoe. It will be appreciated that the means for providing the adjustments will have to accommodate especially the pitch of the last and also the amount of offset of the heel end portion of the last in relation to the toe end portion thereof (the shoe being, of course, located in the machine in relation to its toe end). Other facilities for adjustment may also include pivoting the heel seat wiper assembly about an axis extending in the wiping plane, parallel to the direction of in-wiping movement of said assembly.

BRIEF DESCRIPTION OF THE DRAWINGS

There now follows a detailed description, to be read with reference to the accompanying drawings, of a machine in accordance with the invention, said machine being suitable for use in carrying out the method in accordance with the invention. It will of course be realized that the method and machine hereinafter described have been selected for description merely by way of exemplification of the invention, and not by way of limitation thereof.

In the accompanying drawings.

Figure 2:
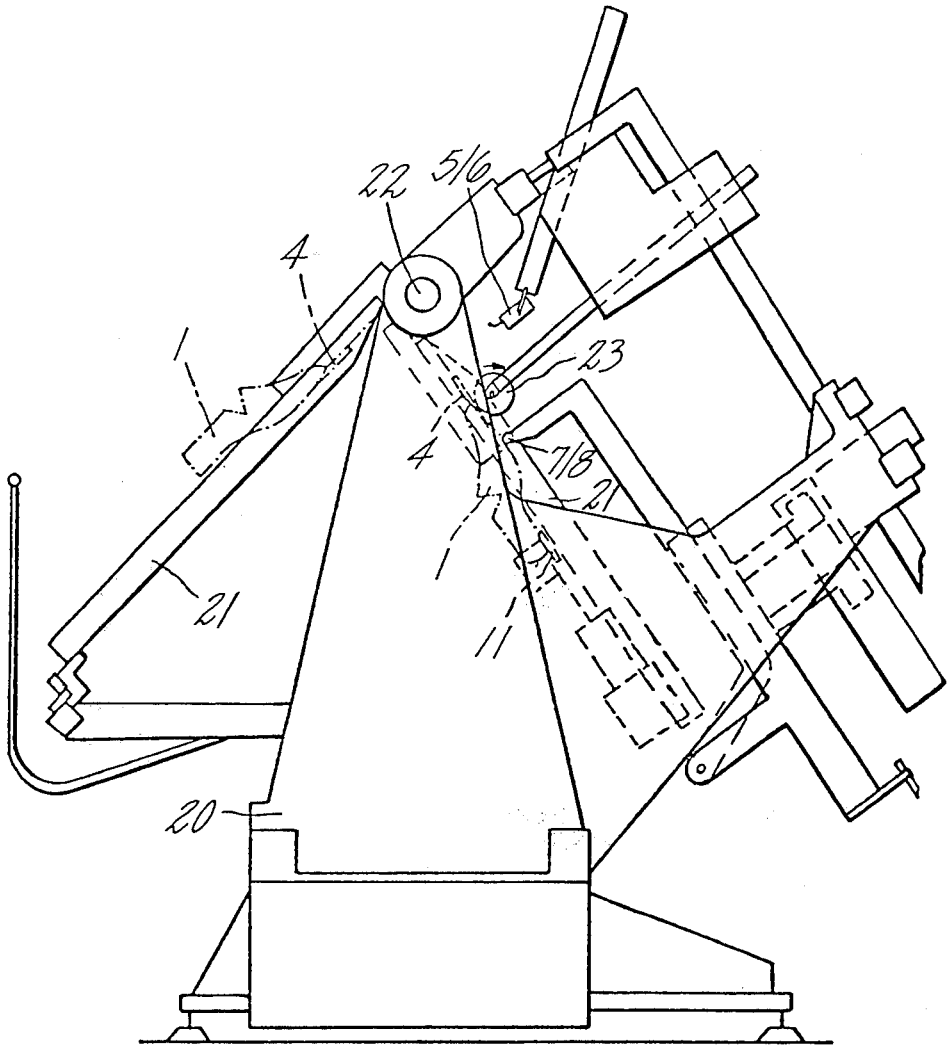
FIG. 2 is a side view of a machine in accordance with the invention.

The machine in accordance with the invention is a machine for lasting the whole of a shoe and is generally similar, except as hereinafter described, to the machine described in U.K. patent specification No. 1341461. Thus, the machine comprises a first, loading station having a last support (not shown) on which a shoe, comprising an upper 1 and an insole 2, can be carried, and pulling over instrumentalities (not shown) by which the upper is tensioned over the last. In addition, the machine comprises two lasting units, each unit having a frame 21 pivotal, in a housing 20 of the machine about an axis 22, from a loading position (shown in full line in FIG. 2), in which a shoe can be received thereby from the loading station, rearwardly of the machine to an operating position (shown in dotted line in FIG. 2), in which the lasting of the shoe bottom can take place. The frame 21 supports a toe lasting wipe assembly 4, the arrangement being such that the wipers are actuated, while the frame 21 is in its loading position, to move the plates thereof to an intermediate position in which they trap the upper 1 against the insole 2, the pulling over instrumentalities thereby releasing the upper and the last support falling away. With the upper held as aforesaid, the frame is then caused to pivot to its operating position, at which, firstly, a trimmer 23 trims the lasting margin 3 of the upper, and thereafter adhesive is applied between the lasting margin 3 of the upper and corresponding marginal portions of the insole 2 and lasting is effected, as will be hereinafter described.

In using the above machine, in carrying out the method in accordance with the invention, with the shoe held in the operating position, first adhesive applying means, in the form of applicator nozzles 5, 6 apply adhesive in the toe region, starting at the ball region and terminating at the toe end. Before the toe lasting wipers 4 are actuated, however, to complete the lasting operation at that region, means (not shown) is provided for bringing the side lasting instrumentalities, in the form of two lasting rolls 7, 8, arranged one at either side of the last, into an operative condition, each lasting roll having associated therewith a further nozzle 9, 10 (constituting second adhesive applying means of the machine), the arrangement being that the nozzles 9, 10 apply adhesive, in advance of the lasting rolls 7, 8, progressively along side portions of the shoe bottom, the lasting rolls 7, 8 thereafter wiping the lasting margin 3 over corresponding marginal portions of the insole 2 and securing said marginal portions together. In this machine, the lasting rolls 7, 8 and nozzles 9, 10 are moved relative to the shoe bottom.

In the machine in accordance with the invention, furthermore, a heel seat lasting wiper assembly 11 is provided which is actuated after adhesive has been applied in the heel seat region. For there applying adhesive, the nozzles 9, 10 are used, the arrangement being such that, when the side lasting operation is completed, the lasting rolls 7, 8, and thus the nozzles 9, 10, are arrested at the point of termination of the side lasting, and the nozzles continue to discharge adhesive which is thereby caused to run into the heel seat region. Because of the inclination of the shoe bottom (see FIG. 2), furthermore, the running of the adhesive into the heel seat region is thereby enhanced. Alternatively, if desired, the nozzles 9, 10 may be mounted in a variable relationship with the lasting rolls 7, 8 so that, when the movement of the lasting rolls 7, 8 is terminated as aforesaid the movement of the nozzles 9, 10 can continued into the heel seat.

In a cycle of operation of the machine in accordance with the invention, in carrying out the method in accordance with the invention, firstly adhesive is applied in the toe region by the nozzles 5, 6, while the lasting rolls 7, 8 and nozzles 9, 10 are retracted from their operative condition so as not to impede the movement of the nozzles 5, 6. Thereafter, the lasting rolls 7, 8 and nozzles 9, 10 are brought into engagement with the shoe and are caused to operate progressively along side portions thereof, starting at the ball region and terminating at the heel breast line region of the shoe bottom. Immediately after the lasting rolls 7, 8 have left the ball region, the toe lasting wiper assembly 4 is actuated to move from its intermediate position to a fully closed position, thereby lasting the toe region of the shoe. The initial position of the lasting rolls 7, 8, furthermore, is such that the toe lasting wipers 4 overlap a region which has previously been lasted by the lasting rolls 7, 8, so as to ensure that the whole of the lasting margin 3 is secured to the insole 2 in the ball region of the shoe bottom. When the side lasting operation is terminated, the lasting rolls 7, 8, no longer rotating, remain applying pressure to the lasting margin 3 at the point of termination, while adhesive is applied in the heel seat region as aforesaid, whereafter the lasting roll 7, 8 and nozzles 9, 10 are moved out of operative condition and the heel seat wiper assembly 11 is actuated to cause the heel seat region to be lasted. As with the toe end, the point of termination of the side lasting is so arranged in relation to the heel seat that the heel seat wipers overlap an area which has previously been lasted by the lasting rolls 7, 8, so that in the heel seat region also it is ensured that the whole of the lasting margin 3 is secured to the insole 2.

Figure 1:
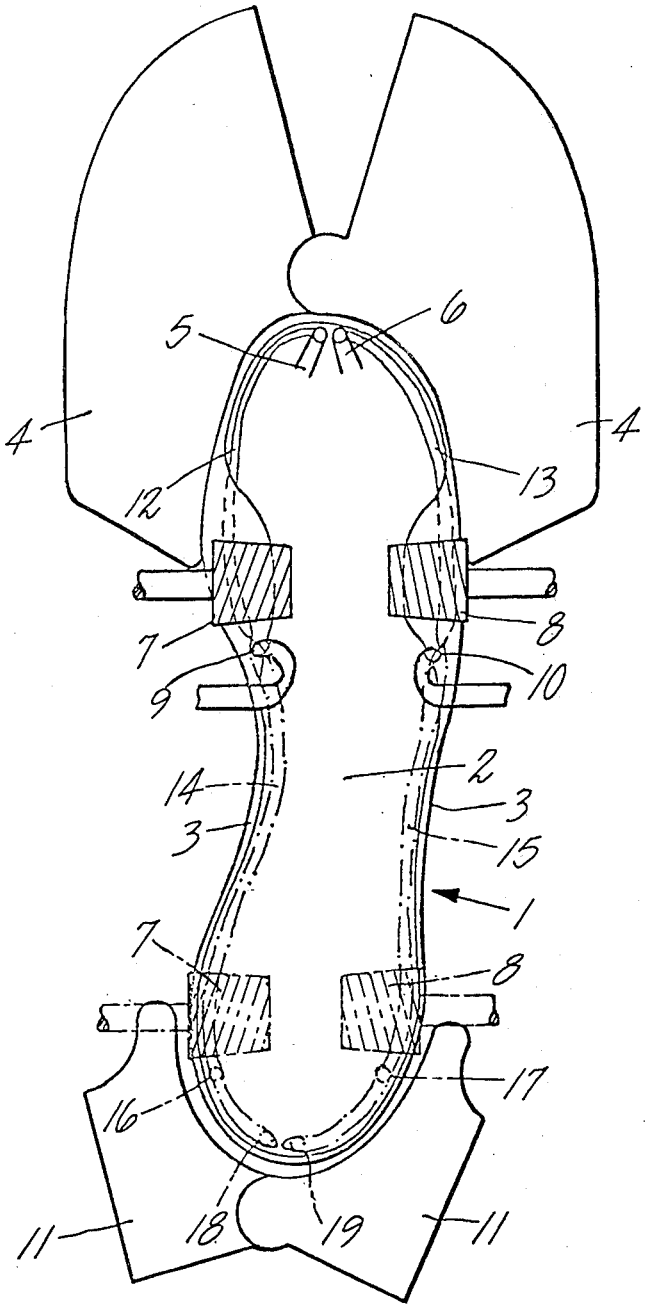
FIG. 1 is a diagram showing a shoe to be lasted, together with lasting instrumentalities for the toe, side and heel seat of the shoe, and also adhesive applying means.

Viewing FIG. 1, the lasting rolls 7, 8 are shown in full line in their initial position, and in chain-dot line in their terminal position. 12, 13 indicate beads of adhesive applied by the nozzles 5, 6, while 14, 15 indicate beads of adhesive applied by the nozzles 9, 10. 16, 17 indicate the positions in which the nozzles 9, 10 are arrested, together with the lasting rolls 7, 8, and 18, 19 indicate the position to which the nozzles may be moved, after termination of the movement of the lasting rolls 7, 8, in a machine where the relationship between the lasting rolls 7, 8 and nozzles 9, 10 is not fixed.

Figure 3:
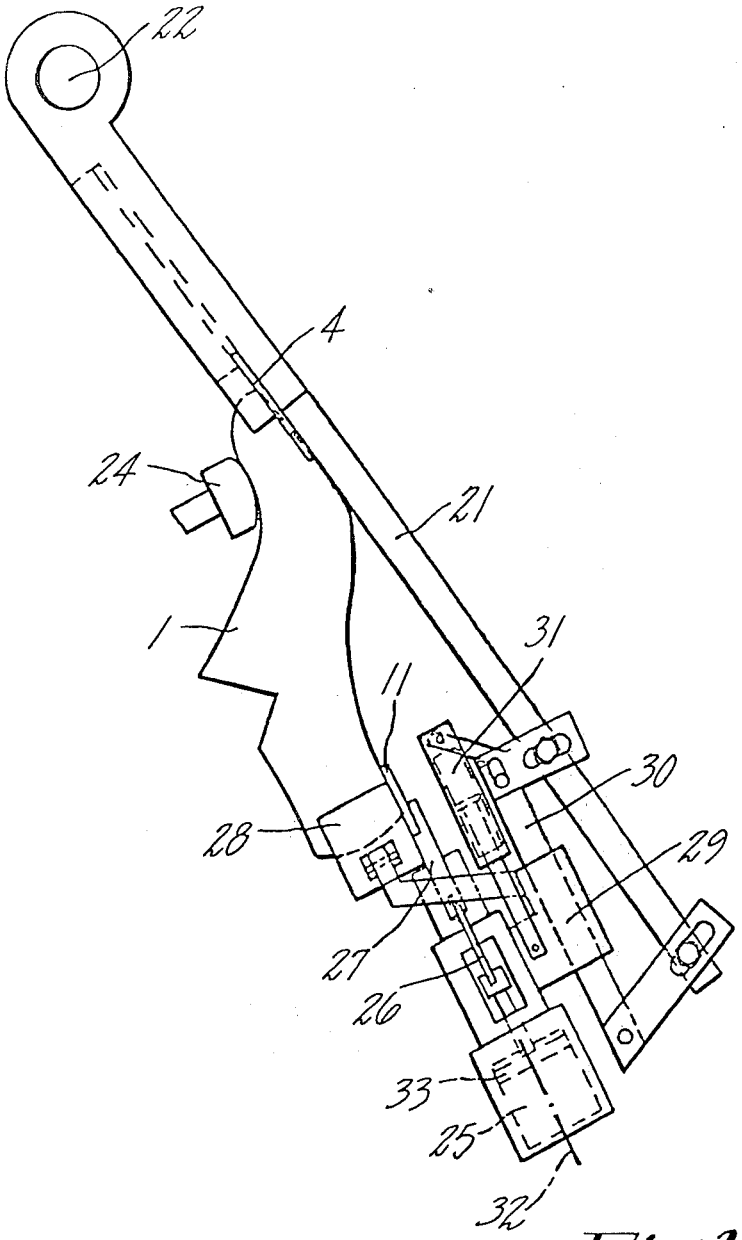
FIG. 3 is a fragmentary view of the machine, showing the relationship between the toe lasting and heel seat lasting instrumentalities.
Figure 4:
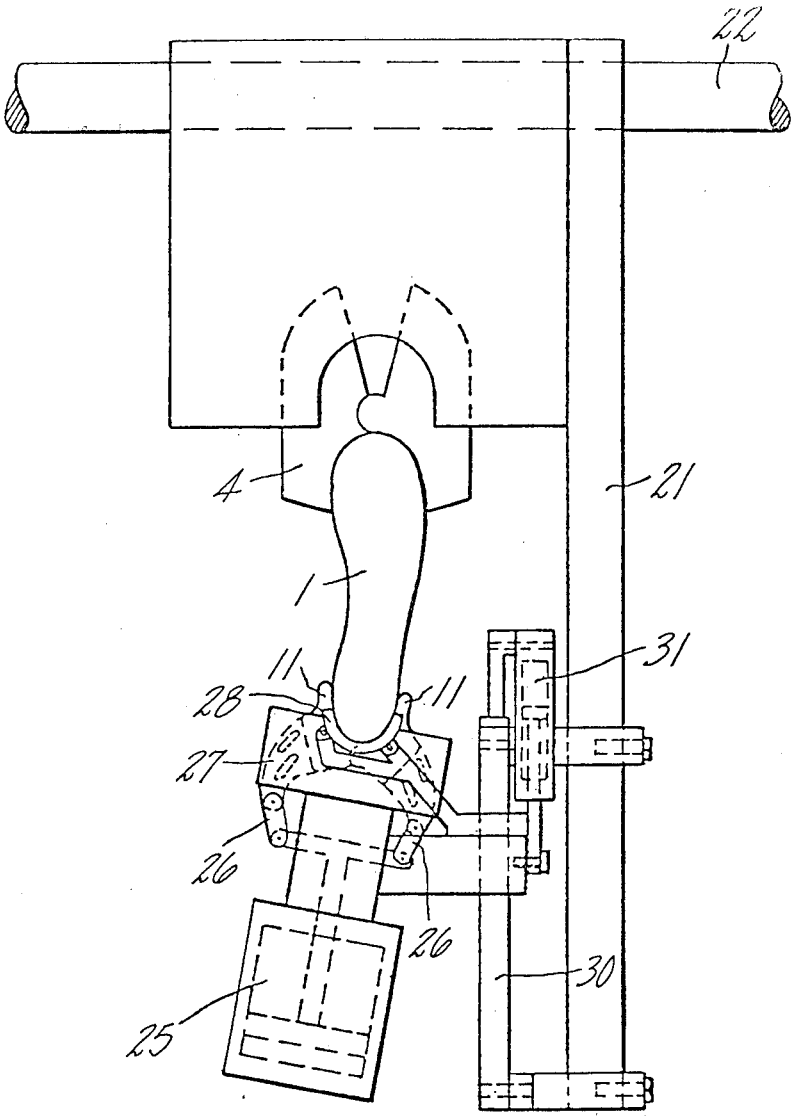
FIG. 4 is a plan view of parts shown in FIG. 3.

Referring now to FIGS. 3 and 4, the frame 21 which supports the toe lasting assembly 4, also supports a toe pad 24, which co-operates with the wipers 4, in the intermediate position of the latter, to support the last after it is moved away from the loading station. Furthermore, the frame 21 carries the heel seat lasting assembly 11, which is actuated in known manner by a pneumatic piston-and-cylinder arrangement 25, acting through links 26 and a cam plate arrangement generally designated 27. In addition, a heel band 28 is provided by which the last is also supported, when removed from the loading station.

The heel band 28 and the heel seat lasting instrumentalities 11 are together supported on a slide 29 which is slideable along a rail 30 under the action of a piston-and-cylinder arrangement 31. The rail 30 is carried by the frame 21 for angular and bodily adjustment relative thereto (see FIG. 3), thus providing a facility for adjusting the wiping plane of the heel seat wiping assembly 11 in relation to the shoe bottom. In addition, the heel seat lasting assembly 11 can be adjusted in relation to the toe lasting assembly 4 by means (not shown), but including the capability of the heel seat wipers 11 pivoting about an axis extending, lengthwise of the shoe bottom, in the wiping plane of said wipers. This axis is coincident with the axis of a piston 33 of the piston-and-cylinder arrangement 25 by which the heel seat lasting wipers 11 are actuated.

Figure 5:
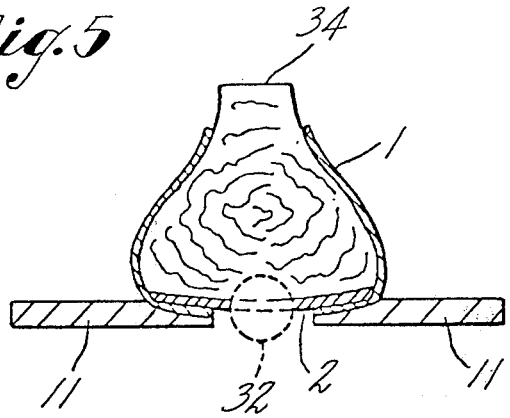
FIG. 5 shows a section through a lasted shoe with the heel seat lasting wiper assembly which is arranged in this case for rotation about an axis extending lengthwise of the shoe.

From FIG. 5 it is apparent that the heel seat lasting wiper assembly can rotate in relation to the shoe 1 about the axis 32 shown in dotted in FIG. 5, which axis extends lengthwise of the shoe 1 at the level of the insole 2. This has the advantage that, as a result of the free rotatability of the heel seat lasting wiper assembly 11, the latter can accommodate itself automatically to different orientations of the insole 2. The axis 32 is formed in accordance with FIG. 3 by the axis of the piston 33 of the piston-and-cylinder unit 25. This axis is indicated by chaindot line in FIG. 3.

In carrying out the method which lies at the base of the invention, as already set out above, the heel support must effect on the shoe not only a pressure which is effective lengthwise of the shoe, it must also be able to withstand the pressure applied by the heel seat lasting wiper assembly 11 to the insole 2. For this purpose the heel support has a shape accommodated to the last 34, which shape can be seen from the sectional view in accordance with FIG. 6. As is apparent, the heel support 28 consists of two jaws **28*a* and 28*b*, which clamp on the taper of the last 34 and follow it, so that a pressure exerted in the direction of the arrow shown on to the last 34 can be accommodated by the jaws 28*a* and 28*b*. The jaws 28*a* and 28*b* are held by links 35 and 36, via which the jaws 28*a* and 28*b* can be swung sideways by the last 34. This swinging movement takes place before the shoe is inserted in the loading position, whereafter the jaws 28*a* and 28*b* are swung into engagement with the last 34**. Heel supports of this type, consisting of two jaws, are known per se.

Figure 6:
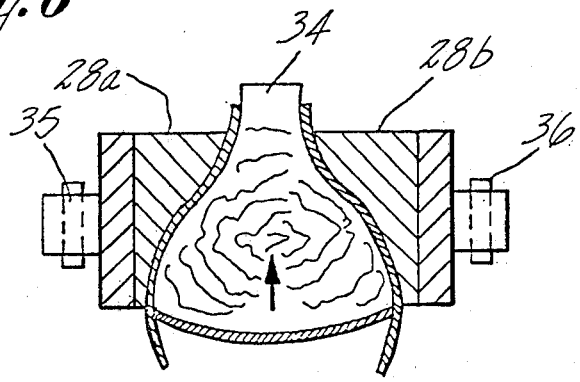
FIG. 6 shows a section through a lasted shoe and the heel support abutting thereagainst.
Figure 7:
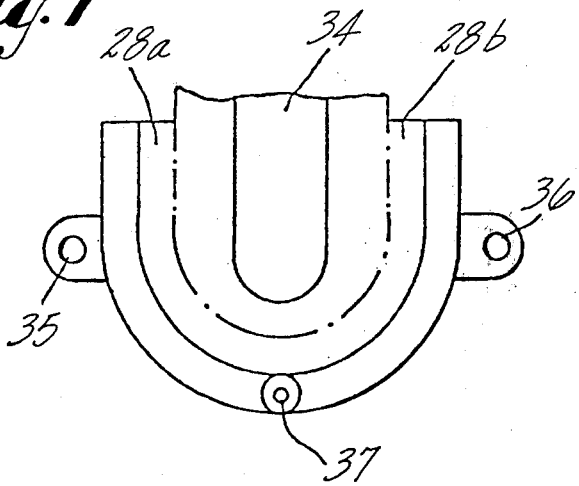
FIG. 7 is a plan view of the arrangement of FIG. 6.

In FIG. 7 is shown a plan view of the arrangement according to FIG. 6. From this drawing the hinge 37 is to be seen, which holds the two jaws **28*a* and 28*b*** together.

We claim:

1. Method of lasting shoes comprising the steps of applying adhesive between lasting marginal portions of the shoe upper and corresponding marginal portions of an insole along the side portions and in the heel seat region of the shoe, and lasting said side portions and the heel seat, wherein the side portions are lasted progressively, using lasting rolls starting from the ball region of the shoe bottom and terminating at the heel seat region thereof, adhesive being applied progressively, in advance of the lasting rolls, along the side portions of the shoe, and the heel seat is lasted using wiper plates which overlap the area previously lasted by the lasting rolls, and further wherein, when the lasting of the side portions is completed, the lasting rolls are maintained in contact with the shoe bottom, and thus pressure is applied thereby to the shoe bottom, at the point of termination of the side lasting, while adhesive continues to be applied progressively in the heel seat region, whereafter the applied pressure is removed by retraction of the lasting rolls and the heel seat region is lasted.

2. Method according to claim 1 wherein the lasting rolls each comprise a wiping element disposed helically about the circumference of the roll, the in-wiping of the lasting marginal portions of the shoe upper being effected by rotation of the roll about its axis, and further wherein when the side lasting is terminated, rotation of the rolls is also terminated.

3. Method according to claim 1 or claim 2 wherein the shoe upper is first pulled over on a last to which the insole is attached and is held tensioned thereon while adhesive is applied to the toe end region of the shoe bottom, and further wherein, as soon as the ball region of the shoe has been lasted by the lasting rolls, the toe end region is lasted using wiper plates which overlap the area previously lasted by the lasting rolls.

* * * * *